US005542479A

United States Patent [19]

Stachler et al.

[11] Patent Number: 5,542,479

[45] Date of Patent: Aug. 6, 1996

[54] HAND OPERATED IMPACT TOOL

[76] Inventors: Thomas H. Stachler; Edward C. Hass, both of P.O. Box 26129, Dayton, Ohio 45426

[21] Appl. No.: 263,454

[22] Filed: Jun. 22, 1994

[51] Int. Cl.[6] ..... B25D 1/04

[52] U.S. Cl. ..... 173/90; 173/126; 173/132

[58] Field of Search ..... 173/90, 91, 126, 173/132

[56] References Cited

U.S. PATENT DOCUMENTS

| | | | |
|---|---|---|---|
| 716,274 | 12/1902 | Peirce, Jr. | 173/91 |
| 2,475,041 | 7/1949 | Mattson | 173/91 |
| 3,050,095 | 8/1962 | Prather . | |
| 3,113,478 | 12/1963 | Hall, Jr. et al. | 173/91 |
| 3,696,873 | 10/1972 | Anderson | 173/90 |
| 4,310,057 | 1/1982 | Brame . | |
| 4,470,440 | 9/1984 | Thor | 173/90 |
| 5,058,686 | 10/1991 | Redwine . | |
| 5,174,388 | 12/1992 | Williams et al. | 173/90 |

*Primary Examiner*—Scott A. Smith
*Attorney, Agent, or Firm*—Jacox, Meckstroth & Jenkins

[57] ABSTRACT

A grounding rod or other article is manually driven into the ground by an impact tool including an elongated guide shaft or rod having a center axis and upper and lower end portions. The lower end portion of the rod is secured by a cross pin to a coupler including a cylindrical body of electrical insulating material. The body defines a cavity extending downwardly from a metal anvil pad embedded within the body, and the cavity is formed by angularly related wedge surfaces extending from a slot. The slot opposes a threaded fastener extending radially through a flanged nut also embedded within the body. A cylindrical metal weight or hammer is slidable on the guide rod for impacting the coupler, and the hammer carries a pair of freely rotatable knobs disposed circumferentially at an angle less than 180°. A ring is secured to the upper end portion of the guide rod by a cross pin for retaining the hammer, and a circular bubble level is recessed within the top of the hammer for indicating when the impact tool is vertical.

16 Claims, 1 Drawing Sheet

10
73
72
15
64
54
61
56
50
67
17
22
20
43
44
24
12
66
52
58
27
30
34
41
36
32
3
3
12
32
34
61
54
43
44
41
36
24
50
20
36
32
41
34
43
30
32
82
24

HAND OPERATED IMPACT TOOL

BACKGROUND OF THE INVENTION

In the art of hand operated impact tools of the general type disclosed, for example, in U.S. Pat. No. 3,050,095, No. 4,310,057 and No. 5,058,686, it is frequently desirable to use the tool for driving rods or stakes or other articles of various sizes or shapes into the ground and sometimes precisely vertical, such as required by surveyors' stakes. It is also desirable for the impact tool to accommodate the various sizes and shapes of articles without requiring different couplings or inserts within a coupling. In addition, it has been found desirable for a hand operated impact tool to be electrically insulated from the article being driven into the ground. This is especially important when driving a grounding rod into the ground in order to prevent the operator from being electrically shocked should the rod accidentally penetrate an underground electrical cable.

SUMMARY OF THE INVENTION

The present invention is directed to an improved hand operated impact tool for driving an article into the ground and which provides all of the desirable features mentioned above. That is, the impact tool of the invention conveniently accommodates rods and stakes of different sizes and shapes, is electrically insulated to prevent an accidental electrical shock from an underground cable and is convenient to use for driving a rod or stake vertically into the ground.

In accordance with one embodiment of the invention, an elongated guide shaft or rod has a lower end portion secured to a coupler including a cylindrical body of a rigid plastics material. The body defines a cavity having a bottom opening and extending from a steel anvil pad embedded within the body. The cavity is defined by a pair of angularly arranged wedge surfaces connected by a part cylindrical surface and a slot which opposes a threaded fastener extending through a flanged nut also embedded within the coupler body. The cavity conveniently accommodates cylindrical rods or stakes of different diameters and also receives other non-circular articles such as a T-type fence post.

A cylindrical metal weight or hammer has a center bore for slidably receiving the guide rod, and a pair of freely rotatable knobs are supported by shafts extending radially outwardly from the weight at a angle of about 170°. The weight is retained on the guide rod by an annular bumper ring secured to the top end portion of the guide rod by a cross pin, and a circular bubble level is recessed into the top surface of the weight for indicating when the tool is vertical.

Other features and advantages of the invention will be apparent from the following description, the accompanying drawing and the appended claims.

DESCRIPTION OF THE PREFERRED EMBODIMENT

Figures 1, 2, 3, 4:
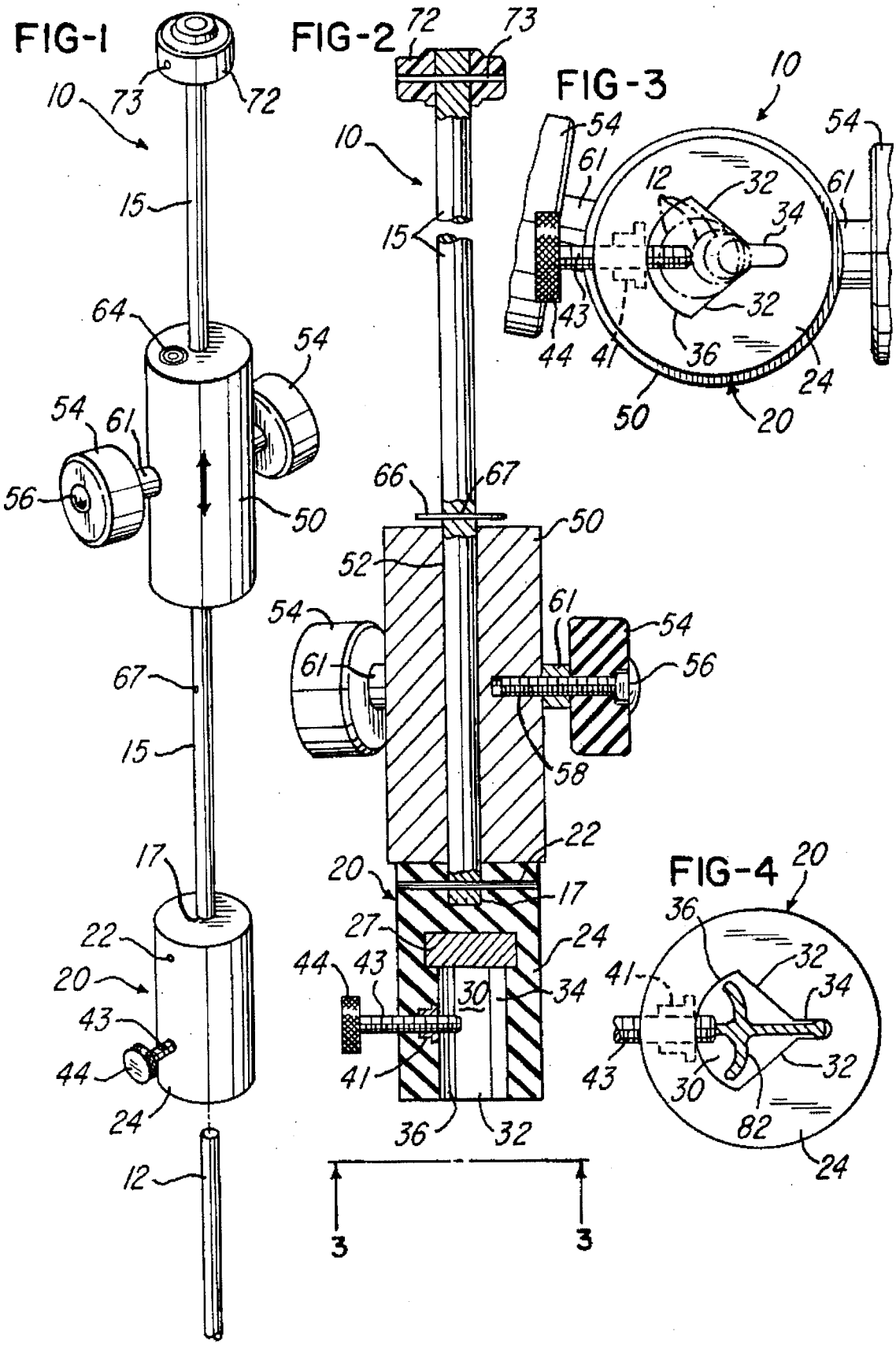
FIG. 1 is a perspective view of a hand operated impact tool constructed in accordance with the invention.
FIG. 2 is an axial section of the tool shown in FIG. 1, with a portion removed.
FIG. 3 is a bottom end view of the tool, taken generally on the line 3-3 of FIG. 2 and illustrating how the tool accommodates rods of different diameters.
FIG. 4 is a bottom end view similar to FIG. 3 and illustrating how the tool, 1 receives a T-type fence post to be driven into the ground.

Referring to FIGS. 1 and 2, a hand operated impact tool 10 is particularly suited for driving a cylindrical stake or rod 12 into the ground with repetitive impacts, and the rod 12 may be of various diameters, for example, ranging from ¼" to 1¼" in diameter. The impact tool 10 includes an elongated guide shaft or rod 15 which preferably is constructed of steel or fiberglass. The rod 15 has a lower end portion which projects into a cylindrical bore 17 formed in the top center of a coupler 20 and retained by a cross shear pin 22. Preferably, the coupler 20 includes a body 24 of a rigid polymer or plastics material such as polyethylene terephthalate (PET) having a durometer of about 70 on the D scale.

A cylindrical steel anvil pad 27 is confined within the body 24 and forms the inner end of a cavity 30 which extends to the lower end of the coupler body 24. The anvil pad 27 is placed as an insert within the injection mold when the body 24 is molded of the rigid PET material. As shown in FIG. 3, the cavity 30 is defined by a pair of angularly disposed flat wedge surfaces 32 which define an angle of about 80° therebetween and extend from a slot 34. The cavity 30 is also defined by a part cylindrical surface 36 which opposes the slot 34 and connects the wedge surfaces 32.

A flanged nut 41 (FIG. 2) is also embedded within tile coupler body 24 and is inserted into the injection mold prior to molding the body. The nut 41 receives a threaded fastener 43 having an enlarged head portion 44 with a knurled gripping surface. The fastener 43 extends radially into the axial center portion of the cavity 30 and opposes the slot 34 forming part of the cavity 30.

A cylindrical metal or steel weight member or hammer 50 has a center bore 52 which slidably receives the guide rod 15. The weight member or hammer 50 is moved vertically or axially on the rod 15 by a pair of hand gripping members or knobs 54 each of which is supported for free rotation on a shaft 56 formed by a carriage bolt. Preferably the knobs 54 are formed from hard rubber caster wheels, and the shafts 56 are threaded into corresponding threaded holes 58 which project radially into the hammer 50. A spacer collar 61 is mounted on each shaft 56 to space the corresponding knob 54 outwardly from the hammer 50, and the shafts 56 are positively secured within the corresponding threaded holes 58 by a sealant material such as that sold under the trademark LOCKTITE.

As shown in FIG. 1, a bubble-type circular level 64 is recessed within a bore formed in the top surface of the weight member or hammer 50 and provides a visual indication when the guide rod 15 and tool 10 is precisely vertical during operation of the impact tool. When the hammer 50 is lowered to a position resting on the top surface of the coupler 20, the hammer is retained for transporting the device 10 by a removable spring retaining pin or key 66. The key 66 has a straight leg portion which extends through a cross hole 67 within the guide rod 15, and a curved leg portion (not shown) snaps around the outer surface of the guide rod. A ring 72 of solid plastics material is secured to the upper end portion of the guide shaft or rod 15 by a cross pin 73 and prevents the hammer 50 from sliding off the top end of the guide rod 15 during use of the impact tool.

As illustrated in FIG. 3, the impact tool 10 may be conveniently used for driving various sizes of cylindrical stakes or rods 12 into the ground. That is, the wedge surfaces 32 form a V-shaped seat for receiving stakes or rods of different diameters, for example, ranging from ¼" to 1¼" in diameter. After the upper end portion of the stake or rod 12 is inserted into the cavity 30, the fastener 43 is tightened to secure or clamp the rod against the wedge surfaces 32. After the rod 20 is secured to the coupler 20, the weight member or hammer 50 is lifted on the guide rod 15 by the knobs 54 and then dropped or forced downwardly against the upper end surface of the coupler body 24. This causes the anvil pad 27 to drive the stake or rod 12 into the ground in a step-by-step manner in response to the successive impacts.

As also shown in FIG. 3, the shafts 56 for the hand gripping knobs 54 are arranged to define an angle therebetween of less than 180°, and preferably about 170°. This slight angular relationship provides for more convenient gripping of the knobs 56 while the hammer 50 is shifted axially on the guide rod 15.

Referring to FIG. 4, the impact tool 10 may be used for driving other articles into the ground, and specifically, a T-type metal fence post 82 which fits within the cavity 30. The post 82 has a rib portion which is received within the slot 34 so that the post 82 is positioned substantially within the center of the coupler body 24 with the gravitational center axis of the post 82 substantially aligned with the axis of the guide rod 15. Other articles which may be driven into the ground by the impact tool 10 include various tools such as chisels, wedges, rock breakers and rebar and pipe drivers, each having a shank portion which is received within the cavity 30 and clamped against the surfaces 32 by the fastener 43. The coupler 20 may also receive the shank portion of a tamping pad when it is desired to compact the ground within a hole or around a post.

From the drawing and the above description, it is apparent that the hand operated impact tool constructed in accordance with the invention, provides desirable features and advantages. For example, the coupler body 24 forms an electrical insulator between the weight member or hammer 50 and a metal stake or rod 12 being driven into the ground. Thus the body 24 protects the operator from an electrical shock in the event the rod 12 accidentally makes contact with an underground electrical cable while the anvil pad 27 is driving the stake or rod into the ground.

As another feature, the cavity 30 accommodates posts or stakes of various sizes and shapes without requiring inserts, and the threaded fastener 43 cooperates with the wedge surfaces 32 to secure or lock the various posts or stakes to the coupler 20. The hard rubber-like coupler body 24 also protects the lower end of the hammer 50, and the steel anvil pad 27 protects the coupler body 24 to provide the tool 10 with an extended service life. The angular relation of the hammer knobs 54 also assist in body ergonomics by locating the knobs more conveniently for gripping and moving the hammer 50.

While the form of impact tool herein described constitutes a preferred embodiment of the invention, it is to be understood that the invention is not limited to this precise form of tool, and that changes may be made therein without departing from the scope and spirit of the invention as defined in the appended claims.

The invention having thus been described, the following is claimed:

1. A hand operated impact tool adapted for driving an article such as a stake or rod into the ground, said tool comprising an elongated guide rod having an upper end portion and a lower end portion, a coupler secured to said lower end portion and including a body of electrical insulating material, means defining an axially extending cavity within said coupler for receiving an upper end portion of the article, said means defining said cavity including a hard impact surface at an upper inner end of said cavity and adapted to engage an upper end of the article, an annular weight forming a hammer and supported by said guide rod for axial movement between an upper retracted position and a lower impacting position imparting a downward impacting force against said coupler, and said body of electrical insulating material forming an insulator between said guide rod and the article within said cavity.

2. An impact tool as defined in claim 1 wherein said means defining said cavity include angularly disposed wedge surfaces forming a V-shaped seat adapted for engaging cylindrical articles of different diameters, and an adjustable fastener extending through said coupler for forcing the article against said seat.

3. An impact tool as defined in claim 2 wherein said cavity includes a slot portion extending from said wedge surfaces in opposing relation to said fastener to adapt said cavity for receiving an upper end portion of a T-shaped art idle such as a metal fence post.

4. An impact tool as defined in claim 1 wherein said impact surface is defined by a metal anvil pad embedded within said body of electrical insulating material.

5. An impact tool as defined in claim 1 where in said hammer includes a pair of peripherally spaced and outwardly projecting hand gripping members, and said hand gripping members have corresponding axes defining an angle therebetween of less than 180°.

6. An impact tool as defined in claim 1 wherein said body of electrical insulating material defines said cavity, said body further defines a bore for receiving said lower end portion of said guide rod, and a cross pin extending through said body and said lower end portion of said guide rod for securing said guide rod to said body.

7. An impact tool as defined in claim 1 wherein said hammer includes a pair of outwardly projecting hand gripping knobs, and a corresponding pair of shafts supporting said knobs for free rotation.

8. An impact tool as defined in claim 1 wherein said body of electrical insulating material defines said cavity, a nut member embedded within said body of insulating material and defining a threaded hole extending from said cavity, and a threaded fastener extending through said nut member for securing an upper end portion of the article to said coupler.

9. An impact tool as defined in claim 1 and including a circular bubble level mounted on said tool for indicating when said tool is vertical.

10. An impact tool as defined in claim 9 wherein said hammer has a top surface receiving said bubble level.

11. An impact tool as defined in claim 1 wherein said body comprises a polyethylene terephthalate material.

12. A hand operated impact tool adapted for driving an article such as a stake or rod into the ground, said tool comprising an elongated guide rod having an upper end portion and a lower end portion, a coupler secured to said lower end portion and including a body of electrical insulating material, said body defining an axially extending cavity with an open bottom for receiving an upper end portion of the article, an anvil pad embedded within said body at an upper inner end of said cavity for engaging the upper end of the article, an annular weight forming a hammer and supported by said guide rod for axial movement between an upper retracted position and a lower impacting position imparting a downward impacting force against said body, and said body forming an insulator between said guide rod and the article within said cavity.

13. An impact tool as defined in claim 12 wherein said body includes angularly disposed wedge surfaces defining said cavity and forming a V-shaped seat adapted for engaging cylindrical articles of different diameters, and an adjustable fastener extending through said body for forcing the article against said seat.

14. An impact tool as defined in claim 13 wherein said body defines a slot portion extending from said wedge surfaces and in opposing relation to said fastener to adapt said cavity for receiving an upper end portion of a metal fence post.

15. An impact tool as defined in claim 12 wherein said hammer includes a pair of peripherally spaced and outwardly projecting hand gripping members supported by corresponding shafts for free rotation, and said shafts have corresponding axes defining an angle therebetween of less than 180°.

16. An impact tool as defined in claim 12 and including a circular bubble level mounted on said hammer for indicating when said tool is vertical.

* * * * *